US008230888B2

(12) United States Patent
Crossdale et al.

(10) Patent No.: US 8,230,888 B2
(45) Date of Patent: Jul. 31, 2012

(54) DISPENSING APPARATUS

(75) Inventors: Garry W. Crossdale, Ripley (GB); Barry Hague, S. Yourshire (GB); Brian P. Onufryk, Spondon (GB)

(73) Assignee: Diversey, Inc., Sturtevant, WI (US)

( * ) Notice: Subject to any disclaimer, the term of this patent is extended or adjusted under 35 U.S.C. 154(b) by 1063 days.

(21) Appl. No.: 11/997,854

(22) PCT Filed: Aug. 4, 2006

(86) PCT No.: PCT/US2006/030463

§ 371 (c)(1),
(2), (4) Date: Jul. 2, 2008

(87) PCT Pub. No.: WO2007/019320

PCT Pub. Date: Feb. 15, 2007

(65) Prior Publication Data

US 2008/0302440 A1 Dec. 11, 2008

Related U.S. Application Data

(60) Provisional application No. 60/706,248, filed on Aug. 5, 2005.

(51) Int. Cl.
*B65B 3/04* (2006.01)

(52) U.S. Cl. ..... 141/18; 141/193; 141/360; 141/373; 141/391; 222/153.04; 222/153.13

(58) Field of Classification Search ..... 141/18, 141/192–193, 351, 360–362, 369–370, 373, 141/391; 222/153.01, 153.04, 153.13
See application file for complete search history.

(56) References Cited

U.S. PATENT DOCUMENTS

| | | | | |
|---|---|---|---|---|
| 5,456,297 | A * | 10/1995 | Crossdale et al. | 141/83 |
| 5,682,930 | A * | 11/1997 | Crossdale | 141/104 |
| 5,896,869 | A * | 4/1999 | Maniscalco et al. | 134/1.3 |
| 6,105,633 | A | 8/2000 | Pedersen et al. | |
| 6,568,438 | B2 * | 5/2003 | Crossdale et al. | 141/104 |
| 7,104,467 | B2 | 9/2006 | Crossdale et al. | |
| 2004/0065673 | A1 | 4/2004 | Hansen | |

FOREIGN PATENT DOCUMENTS

| | | |
|---|---|---|
| CN | 1642847 | 7/2005 |
| EP | 0675073 | 4/1993 |
| EP | 0868137 | 10/1998 |
| EP | 1346945 | 9/2003 |
| GB | 2315734 | 2/1998 |

OTHER PUBLICATIONS

International Search Report from the European Patent Office.

* cited by examiner

*Primary Examiner* — Gregory Huson
*Assistant Examiner* — Nicolas A Arnett
(74) *Attorney, Agent, or Firm* — Gregory S. Bollis

(57) ABSTRACT

A dispensing apparatus for delivering fluid or liquid to a container (e.g. a bottle), has a container holding device and a fluid delivery system delivering fluid to a dispensing outlet under control of an actuation member, which causes the fluid delivery system to deliver fluid in response to movement of the actuation member from its start position. A dispensing lock has a first position in which it blocks movement of the actuation member from its start position, and a second position in which it permits movement of the actuation member. A release member that releases the dispensing lock includes a movable release member which is moved by the container, during its insertion into the refill position, so as to release the dispensing lock by bringing the dispensing lock to said second position, thus enabling fluid to be delivered.

9 Claims, 6 Drawing Sheets

DISPENSING APPARATUS

CROSS-REFERENCE TO RELATED APPLICATIONS

This relates to U.S. patent application Ser. No. 10/508,299 filed on Mar. 4, 2003 and EP patent application number 03711374.3 also filed on Mar. 4, 2003, both of which claim priority to EP patent application number 02252051.4 filed on Mar. 21, 2002. The contents of these patent applications are hereby incorporated by reference.

FIELD OF THE INVENTION

The invention relates to the field of fluid dispensers, in particular manually operated dispensers having a lock-out feature to prevent operation of the dispenser until a container is properly positioned on the dispenser.

BACKGROUND OF THE INVENTION

In many organizations, for example in industry, in large kitchens and in large hotels where many rooms need to be cleaned regularly, small containers, such as easily portable bottles, are frequently refilled with cleaning and sanitizing liquids from bulk containers held at a filling station. The dispenser is typically of the type described in EP 0868137. This describes a manually operated dispenser for dispensing measured single shots of fluid from a reservoir into a container positioned beneath the outlet. The containers being filled are typically labeled or colored in order to indicate the liquid which they should contain. There are obvious risks of errors here, that a liquid might be filled into a container for which it was not intended, particularly when many people frequently visit a filling station. Simple color coding systems, whilst helpful, do not remove the possibility of human error.

Attempts have been made to overcome this problem by electronic automated filling systems, but these tend to be very complex, involving for example the reading of bar code labels. Such systems are expensive, they require expert set-up and maintenance, and are prone to the occurrence of faults.

SUMMARY OF THE INVENTION

The present invention seeks to provide a mechanically operated dispensing apparatus which is simple, dependable and low-cost, and which permits the dispensing of a specific liquid into a specific purpose-made container, whilst, at the same time, minimizing the risk of inadvertent filling of containers intended for other liquids and the risk of spillages.

According to one embodiment of the present invention, there is provided a dispensing apparatus for delivering fluid to a container, the apparatus comprising:

container holding means for receiving in use a container having a fill port and a container identifier key, the container holding means including mechanical keying means arranged to permit a container with a predetermined identifier key to be completely inserted to a refill position in the container holding means, a dispensing outlet for delivering fluid to the fill port of a container at the refill position, fluid delivery means for delivering fluid to the dispensing outlet, an actuation member movable from a start position and operatively linked to the fluid delivery means to cause the fluid delivery means to deliver fluid in response to movement of the actuation member from the start position, a dispensing lock having a first position in which it blocks movement of the actuation member from the start position, and a second position in which it permits movement of the actuation member, release means for releasing the dispensing lock including a movable release member which is moved by a container, during its insertion into the refill position in the container retention means, so as to release the dispensing lock by bringing the dispensing lock to the second position, thus enabling fluid to be delivered.

The mechanical keying means preferably comprises one or more keying elements of predetermined shape and configuration, said elements being arranged for cooperation with a predetermined container identifier key having one or more keying elements of corresponding shape and configuration, thereby permitting the complete insertion of the container into the container holding means.

In this manner it is possible for the container holding means to allow the full and complete insertion of a certain type of container whilst blocking the insertion of other types, i.e. types which do not carry a specific identifier key. The specific container identifier key of a container intended for complete insertion into the container holding means is typically configured to cooperate in a mating manner with the mechanical keying means of the container holding means. Preferably either the mechanical keying means or the container identifier key includes an array of projections or an array of recesses or a combination of the two for cooperation with a corresponding mating array of projections and/or recesses on the other of these two parts.

Preferably the movable release member is arranged to be moved by a container during substantially complete insertion of the container into the container holding means. Preferably, the movable release member is located at an end region of a slot of the container holding means, the slot serving to receive a correctly inserted container, so that the container makes contact with and moves the movable release member at the end of its travel in the slot, during insertion.

The movable release member includes a rotatably or pivotally mounted member or arm arranged and positioned for interaction with an inserted container. The arm is coupled to a shaft or rod that extends toward a dispensing locking mechanism. The release member can also have a second arm arranged and movably positioned to act as the dispensing lock or for interaction with the dispensing lock.

The pivotally mounted member of the movable release member is preferably located in close proximity to the container holding means. The pivotally mounted member of the movable release member is more preferably located in close proximity to the furthest point of travel into the container holding means of a fully inserted container.

The shaft of the movable release member is preferably mounted so as to extend substantially entirely in a vertical or near vertical plane. The lever arm is preferably located at one end of the shaft. In some embodiments, lever arms are coupled at substantially opposite ends of the shaft. Rotation of one lever arm causes rotation of the other lever arm via rotation of the shaft.

The dispensing lock means preferably has at least one locking member that is movable to selectively block movement of an actuation member. In one position, the locking member acts to block movement of the actuation member (i.e. plunger) and thereby prevent actuation of the piston. In a second position, the locking member permits the actuation member to move in response to an externally applied force.

Preferably the movable locking member is a pivotally mounted arm which is capable of rotation between said first and second positions in response to movement of the release means. In some embodiments, the arm pivots about an axis that is parallel to the shaft. In other embodiments, the aim pivots about an axis that is normal to the shaft.

The fluid delivery means preferably includes a working chamber and a piston means, the working chamber being selectively communicable with a fluid supply i.e. tank or reservoir within the apparatus and the dispensing passage. The working chamber can be of any convenient shape but will typically take the form of a cylinder or a cylinder of circular cross-section i.e. for cooperation with a circular piston.

Typically either the piston means or the boundary wall of the working chamber i.e. the cylinder, will be movable relative to the dispensing apparatus, whilst the other will be fixed. Either one or the other is then preferably actuable in response to movement of the actuation member to pressurise fluid in the working chamber for delivery to the dispensing passage.

The actuation member is preferably at least partially exposed to the exterior of the apparatus. The actuation member is preferably a plunger which is arranged for movement independently of the piston (or working chamber/cylinder, cylinder wall, whichever is movable), said actuation member being movable in response to an externally applied force i.e. when depressed by an operator, to move the piston and thereby pressurise the fluid in the working chamber and deliver fluid from the dispensing passage.

The actuation member may take other forms such as a button or lever to which force can be applied by an operator.

It is envisaged that the present invention will be used with any suitable shape, size and type of container with a port suitable for refilling the container and a container identifier key suitable for use with the present dispensing apparatus. It is also envisaged that the containers for use with the dispensing apparatus of the present invention may also include aspects of other recognition systems such as color, shape etc. to visually assist the operator before he makes an attempt at inserting a container into the dispensing apparatus.

Further aspects of the present invention, together with the organization and operation thereof will become apparent from the following detailed description of the invention when taken in conjunction with the accompanying drawings.

INTRODUCTION OF THE DRAWINGS

An embodiment of the invention will now be described by way of example, with reference to the accompanying drawings, in which:—

DESCRIPTION OF THE PREFERRED EMBODIMENTS

Figure 1:
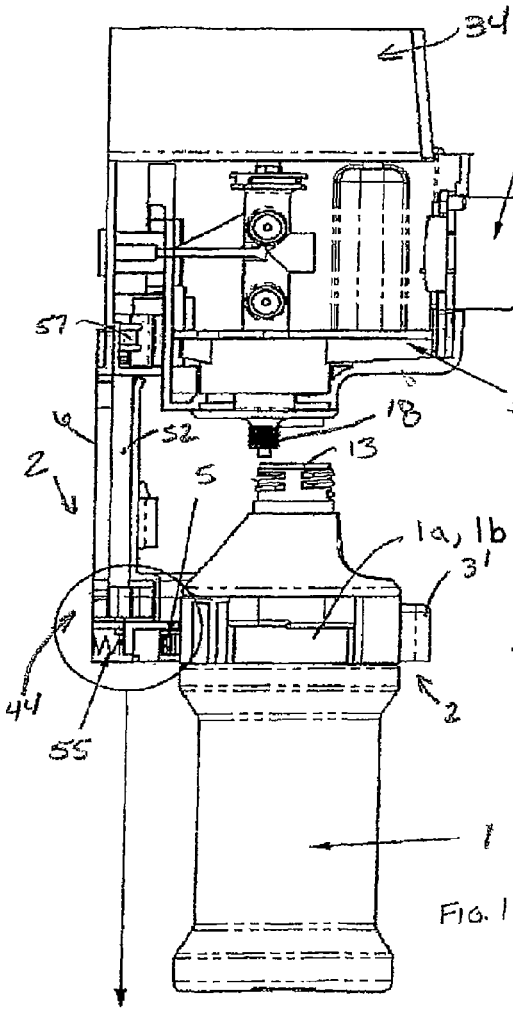
FIG. 1 is a partial cross-sectional side view of a dispenser embodying aspects of the present invention. A bottle is shown being inserted into the dispenser, but the bottle is not fully inserted into the dispenser.
Figure 2:
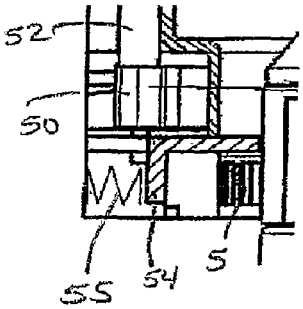
FIG. 2 is a detail view of a portion of FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The term "coupled" is used broadly and encompasses both direct and indirect mounting, connecting and coupling. Further, "connected" and "coupled" are not restricted to physical or mechanical connections or couplings, and can include electrical connection or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

The fluid dispensing devices shown in FIGS. 1 to 10 and 11-13 each have a fixed frame structure in the form of an enclosed housing 30, 34 and a bottle retainer or container holding bracket 2 including a back plate 6 which is either joined or unitary with the housing 30, 34. The housing 30, 34 and bottle retainer 2 can be mounted on a vertical wall such as a building wall. The housing generally has a top box 34 which carries a removable or refillable reservoir (not shown) of fluid to be dispensed, and a lower housing portion 30 in which the dispensing mechanism is located. The lower housing portion 30 is located above a dispensing outlet 18, through which fluid being dispensed is delivered into the filling port 13 of a container located beneath the outlet 18.

The reservoir of fluid to be dispensed (not shown) is arranged within the top box 34 and a passage is arranged between the reservoir and the dispensing outlet 18. Suitable piping arrangements, including valves, can be used to deliver fluid from the reservoir to the outlet 18. One example of such piping is shown in EP-A-868137, which is hereby incorporated by reference. A suitable actuation assembly 20 can be coupled to the piping to allow for selective dispensing of the fluid. The actuation assembly can include a push button pump assembly, such as the one described in U.S. patent application Ser. No. 10/508,299. Briefly, that type of pump assembly comprises a cylinder and piston, which together define a working chamber, that is connected through a common inlet/outlet passage to another passage. The piston is slidably arranged within the cylinder where it is capable of reciprocal movement. A plunger is slidingly mounted on the outside of the piston sleeve and is also arranged to slide within an aperture in the front wall of the housing. The plunger has a flange being of greater diameter than the aperture to ensure that the plunger cannot be removed from the front wall of the housing and therefore serves to define an outwards end position of the plunger when this is not depressed into the dispensing apparatus.

The bottle retainer 2 consists of the two forwardly projecting arms 3, 3' which are attached to the back plate 6, forming a slot-like opening 19 into which a bottle 1 can be inserted. The arms 3, 3' carry rails 4, 4' which are arranged to cooperate with corresponding slots 1*a*, 1*b* in the bottle 1 (the slot 1*b* is disposed in the bottle 1 opposite the slot 1 *a*).

The bottle retainer 2 carries mechanical keying 5 in the form of an arrangement of projections and/or recesses at the base of slot-like opening 19 of retainer 2 for cooperation with an appropriately keyed bottle, as for example described in greater detail in the European patent application EP0675073. A bottle 1 which is intended to be insertable into the retainer 2 carries recesses and/or projections in positions corresponding to the projections at the bottom of opening 19, whereon other bottles cannot be fully inserted into the base of opening 19, which means they cannot reach the refill position. The recesses on the bottle therefore serve as the bottle identifier key and whether or not this matches the projections at the base of opening 19 determines whether a particular bottle type can be fully inserted into a particular dispenser.

Alternatively, the rails 4, 4' can each carry a shaped formation which serves as the mechanical keying of the retainer 2. In this case a bottle 1 which is intended to be insertable into the retainer 2 carries at the bottom of the slots 1*a*, 1*b* formations intended for mating cooperation with the mechanical keying formations of arms 3, 3'. The mechanical keying formations can be designed to allow the insertion into the retainer of a particular type of bottle which carries a corresponding mating container identifier key and to block the insertion of other bottles which do not carry the appropriate identifier key.

Figure 3:
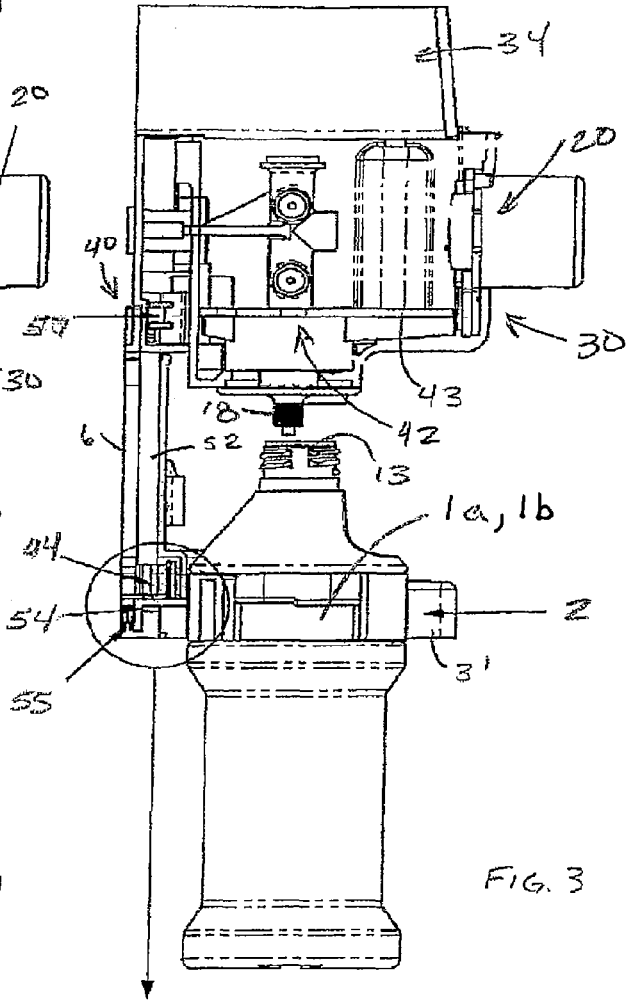
FIG. 3 is a partial cross-sectional side view of the dispenser shown in FIG. 1 with the bottle fully inserted into the dispenser.
Figure 4:
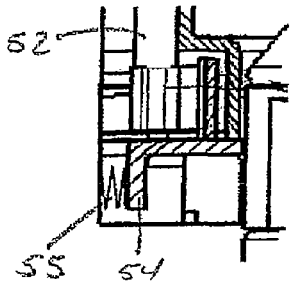
FIG. 4 is a detail view of a portion of FIG. 3.

As can be seen from FIGS. 1 and 3, the bottle 1 is inserted into the dispensing apparatus in a generally horizontal direction as it moves along the guide rails 4, 4'. As illustrated in FIG. 3, the bottle 1 comes to rest in its final insertion position with its filling port 13 directly beneath the dispensing outlet 18. The retainer 2, also includes latches, pips or beads (see FIGS. 8-10) which help to secure the bottle in its fully inserted final position of travel with the dispensing apparatus by engaging with corresponding pips or beads in slots 1*a*, 1*b* on the bottle.

A locking device 40 prevents actuation of the actuation assembly 20 until the correct bottle is fully inserted into the container holding bracket 2. The locking device 40 has a locked and unlocked state. In the locked state, the dispenser cannot dispense. In the unlocked state, the dispenser can dispense. The locking device 40 is biased by a spring 47 to the locked position. Accordingly, the locking device will be held in the locked position until moved to the unlocked position.

The locking device 40 includes a dispensing lock 42 and a release mechanism 44. The dispensing lock 42 is coupled to the dispensing portion of the housing 30 and is positioned to selectively mechanically prevent movement of the actuation assembly 20. The release mechanism 44 is coupled to the dispensing lock 42 to move the dispensing lock 42 between a first position (FIGS. 3 and 5) in which actuation of the actuation assembly 20 is prevented and a second position (FIGS. 6 and 7) in which actuation is allowed. The release mechanism 44 is also coupled to the container holding bracket 2 and positioned to detect when a container is fully inserted into the bracket 2.

The dispensing lock 42 of the illustrated embodiment includes a moveable arm 43. The arm 43 of this embodiment pivots or rotates. However, the arm 43 can move in other manners in other embodiments. The arm 43 rotates between a first position (FIG. 5) in which actuation of the dispenser is prevented and a second position (FIGS. 6 and 7) in which actuation of the dispenser is allowed. In some embodiments, the arm is part of a locking plate having an additional arm 45 for receiving motion (directly or indirectly) from the release mechanism 44. As illustrated, a linkage 46 can extend between a portion of the release mechanism 44 and the additional arm 45 of the locking plate.

Figure 5:
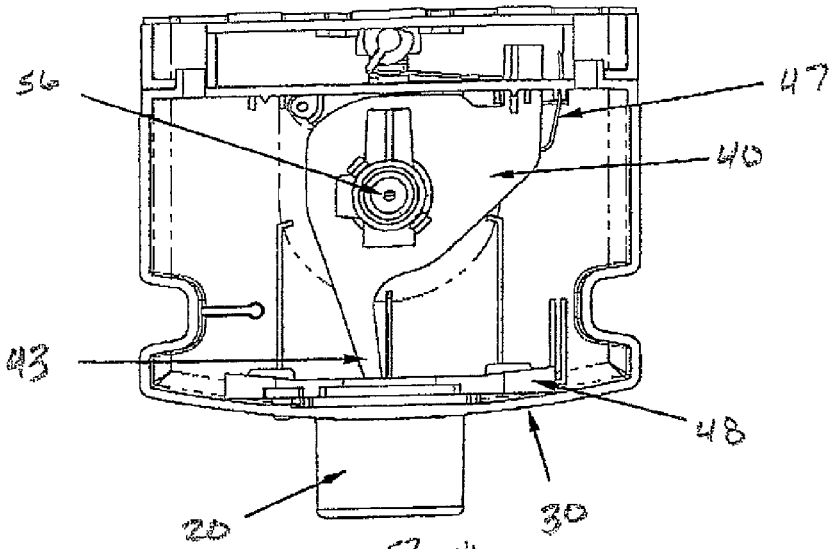
FIG. 5 is a partial cross-sectional top view of the dispenser shown in FIG. 1 showing the dispenser in the locked and non-actuated position.
Figure 6:
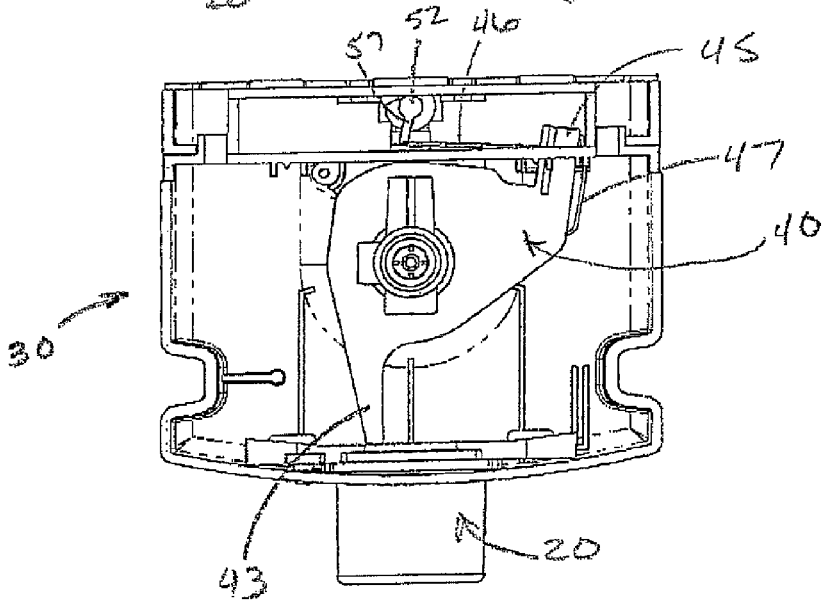
FIG. 6 is a similar view to FIG. 5 with the dispenser shown in the docked and non-actuated position.
Figure 7:
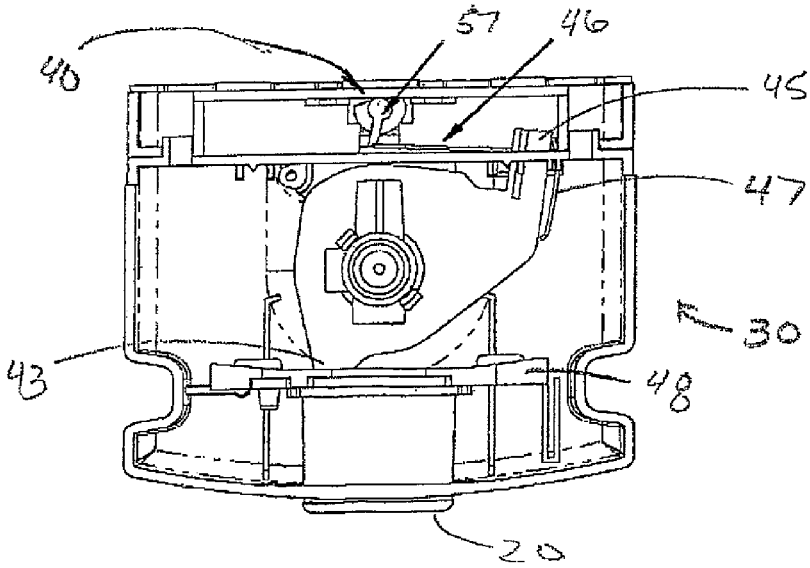
FIG. 7 is a similar view to FIGS. 5 and 6 with the dispenser in the unlocked and actuated position.
Figure 9:
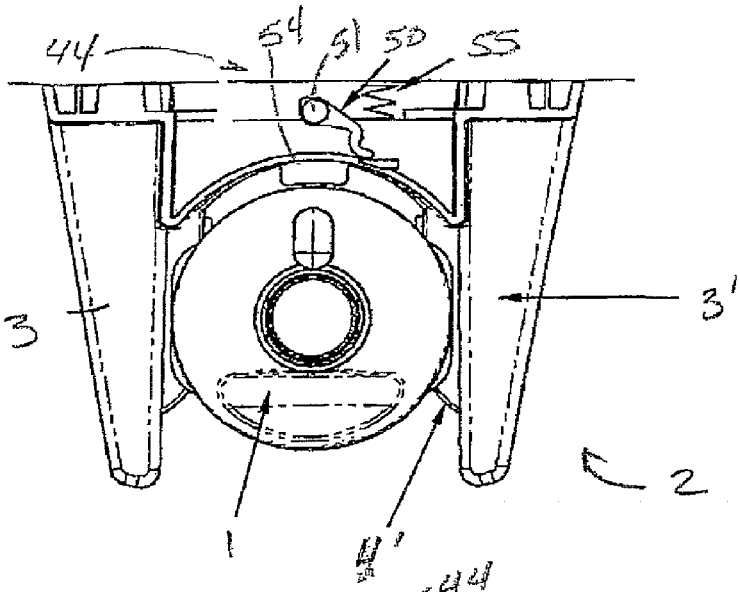
FIG. 9 is a similar view to FIG. 8 with a container being inserted into the bracket, but not yet fully inserted (generally corresponding to FIG. 1).
Figure 10:
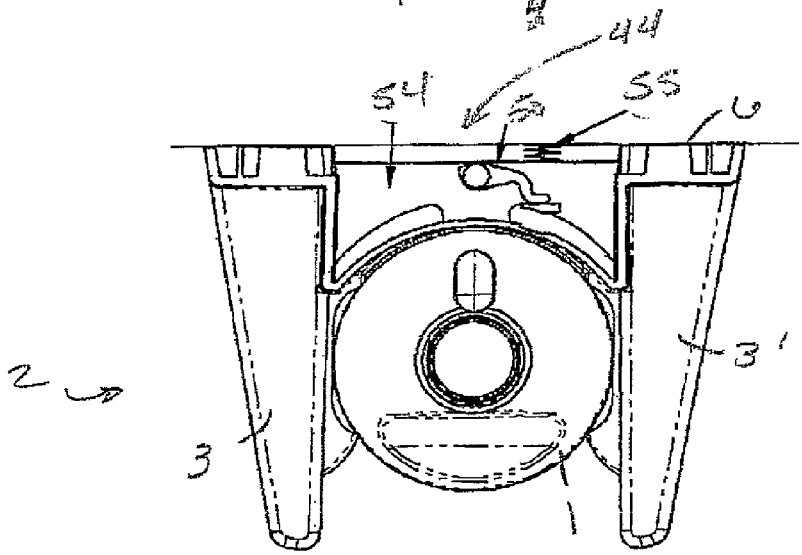
FIG. 10 is a similar view to FIG. 9 with the container shown fully inserted into the bracket (generally corresponding to FIG. 3).
Figure 8:
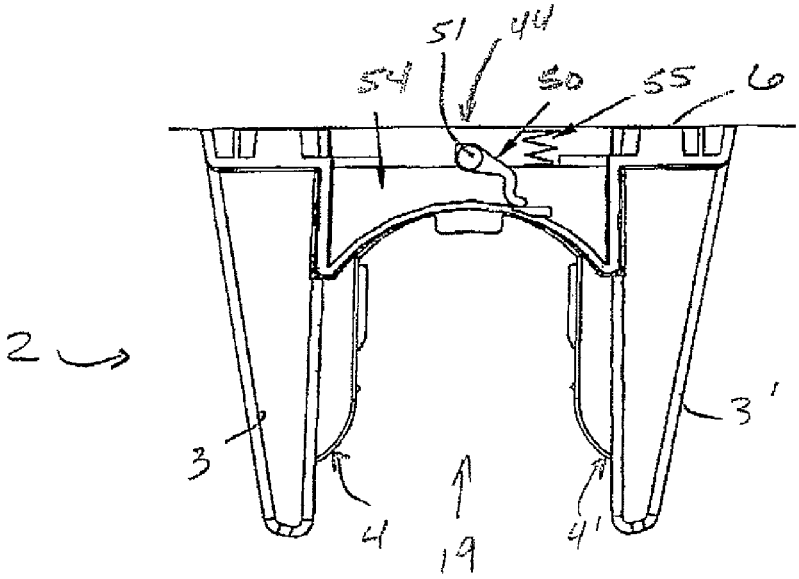
FIG. 8 is a top view of the container holding bracket shown in FIG. 1 without a container positioned in the bracket.

The locking arm 43 of the dispensing lock interferes with the relative movement of the plunger and the cylinder of the activation mechanism 20. As shown in FIGS. 5-7, a plate or flange 48 is coupled to the actuator 20. As long as the locking arm 43 is in blocking position relative to the plate 48, the plate 48 and actuator 20 cannot move towards a dispensing position. However, the locking arm 43 can be moved to a position where it no longer blocks the movement of the plate 48 and actuation of dispenser is allowed Tn one particular embodiment, the locking arm 43 aligns with an aperture in the plate 48 to allow the plate to move to a dispensing position. However, in other embodiments, the locking arm 43 can also be moved away from the plate 48 such that the plate 48 will be allowed to move. When the locking arm 43 is moved to the dispensing position, the plate 48 can then slide inward with the actuator 20. The plate 48 described in this paragraph can be a stand alone part within the dispenser or it can be a part that serves other functions as well. For example, it can be part of the actuator 20, a flange 21 coupled to the actuator 20, and the like.

Release mechanism 44 of this embodiment includes an arm 50 coupled to a shaft 52, wherein the shaft 52 extends along the back plate 6 and is coupled to the dispensing lock 42. The arm 50 of the release mechanism 44 is rotatable between a first position (FIGS. 8 and 9) corresponding to the locked state of the dispensing lock 42 and a second position (FIG. 10) corresponding to the unlocked state of the dispensing lock 42. The arm 50 of the release mechanism 44 moves in response to the correctly keyed bottle being fully inserted into the container holding device 2. This is best shown in FIGS. 1-4 and 8-10. The arm can be directly contacted by the container or as shown in the illustrated embodiment, the container can contact and move a plate 54 that in turn contacts the arm 50. The arm 50 is then pivoted about a pivot point 51 on the container holding device 2. Since the arm 50 is coupled to the shaft 52, this movement causes the shaft 52 to rotate.

In some embodiments, such as the one illustrated, a second arm 57 is coupled to the other end of the shaft 52. This arm 57 is rotated by rotation of the shaft 52. This arm 57 is also coupled to this dispensing lock 42 to selectively move the dispensing lock 42 to the unlocked position upon insertion of a container into bottle holder 2. As shown in FIGS. 5-7, this arm 57 can be coupled to the locking lever via one or more linkages or other mechanical connections. As illustrated, the arm 57 is connected to linkage 46, which is coupled to the locking plate. In other embodiments, the arm can be directly connected to the dispensing lock 42 or it can act on the dispensing lock via other actuation elements, such as gears, cams, springs, and the like. Furthermore, since the arm 57 is not necessary, one or more of these elements can be directly coupled to the shaft or can be acted upon by another type of actuation element coupled to the shaft.

The operation of the dispensing lock 42 and release mechanism 44 is as follows. As shown in FIGS. 3-5 and 8-10, the plate 54 is biased to a forward position when a container is not positioned between or fully inserted into the forward projecting arms 3, 3' of the container holding device 2. As the bottle is fully inserted, it contacts the plate 54 and pushes the plate 54 back toward the back plate 6. The plate 54 is pushed against a biased force of a spring 55. Since the arm 50 of the release mechanism 44 is positioned adjacent the plate 54, movement of the plate 54 also causes movement of the arm 50. As the plate 54 translates backwards toward the back plate 6, the arm 50 is rotated counter-clockwise (with reference to FIGS. 8-10). This causes the shaft 52 to rotate, which also causes the dispensing lock 42 to unlock. Specifically, rotation of the shaft causes the locking arm 43 to move to the unlocked position. As such, the actuator can be moved to allow fluid to be dispensed.

Once the bottle is filled, it can be removed from the container holding device 2. As the bottle is removed, the plate 54 translates toward the front of the dispenser under the bias force of the spring 55. As such, the arm 50 of the release mechanism 44 can be biased to the rest position shown in FIG. 8. The arm 50 can be biased by a separate spring directly coupled to the arm or by one of the springs already utilized in the dispenser. For example, in the illustrated embodiment, a spring within the dispensing portion of the housing can provide sufficient force to cause the release mechanism arm to rotate. Specifically, the spring 47 can act on the lever arm of the dispensing lock 42, which will cause rotation of shaft 52 and arm 50.

Figure 11:
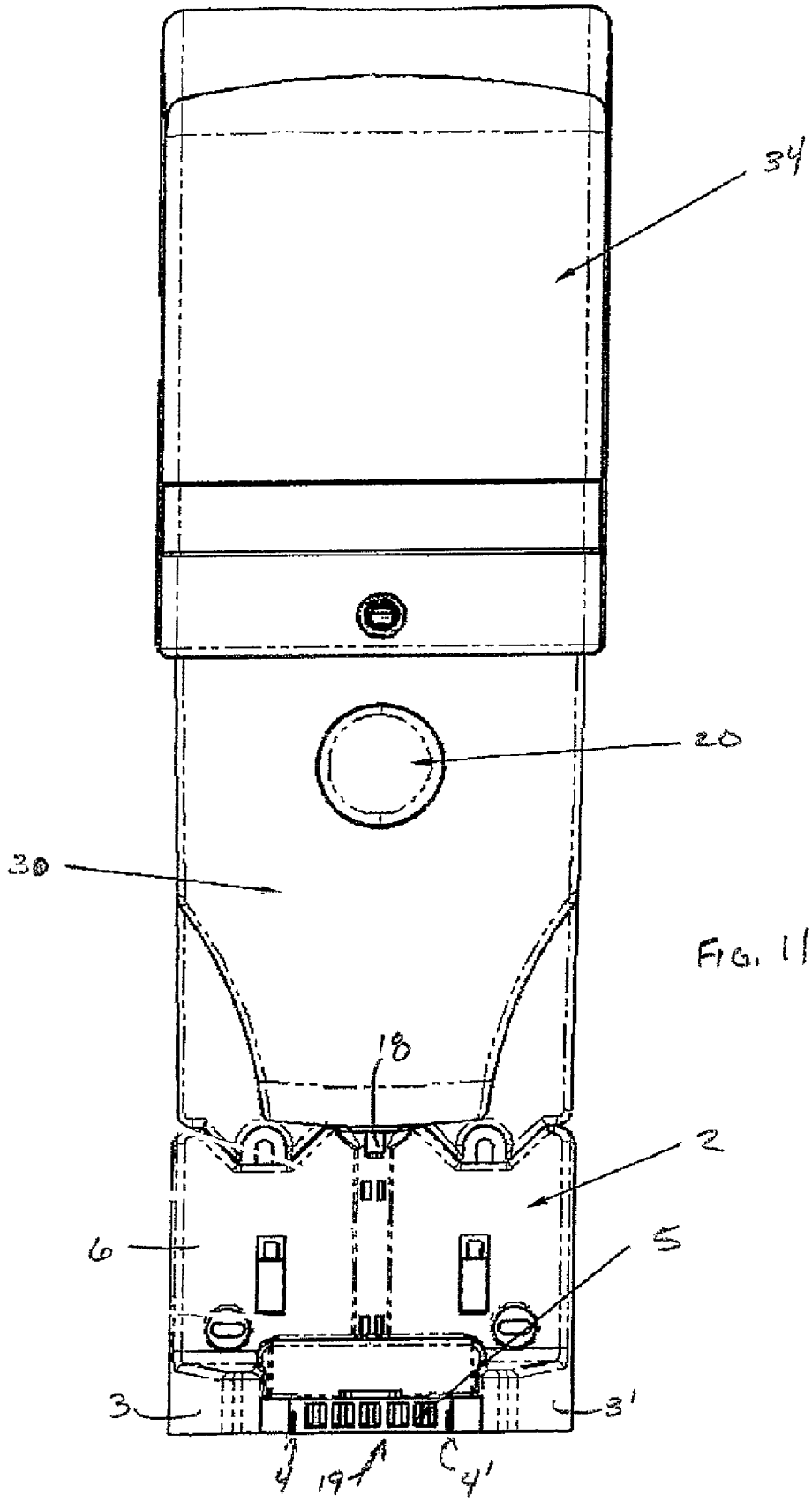
FIG. 11 is a front view of another dispenser embodying aspects of the present invention.
Figure 12:
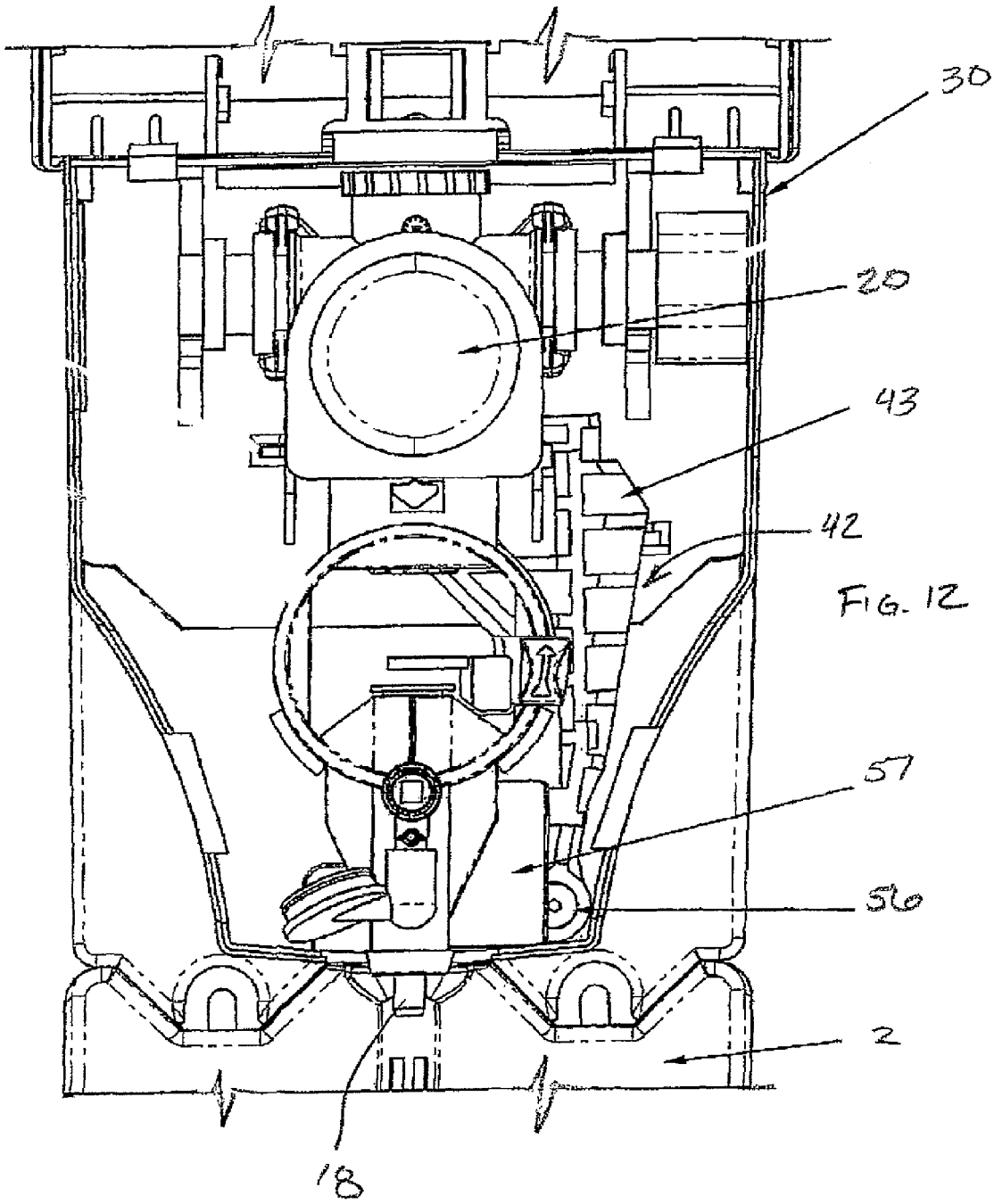
FIG. 12 is a partial front cross-sectional view of the dispenser shown in FIG. 11 with the dispensing portion shown in the locked position.
Figure 13:
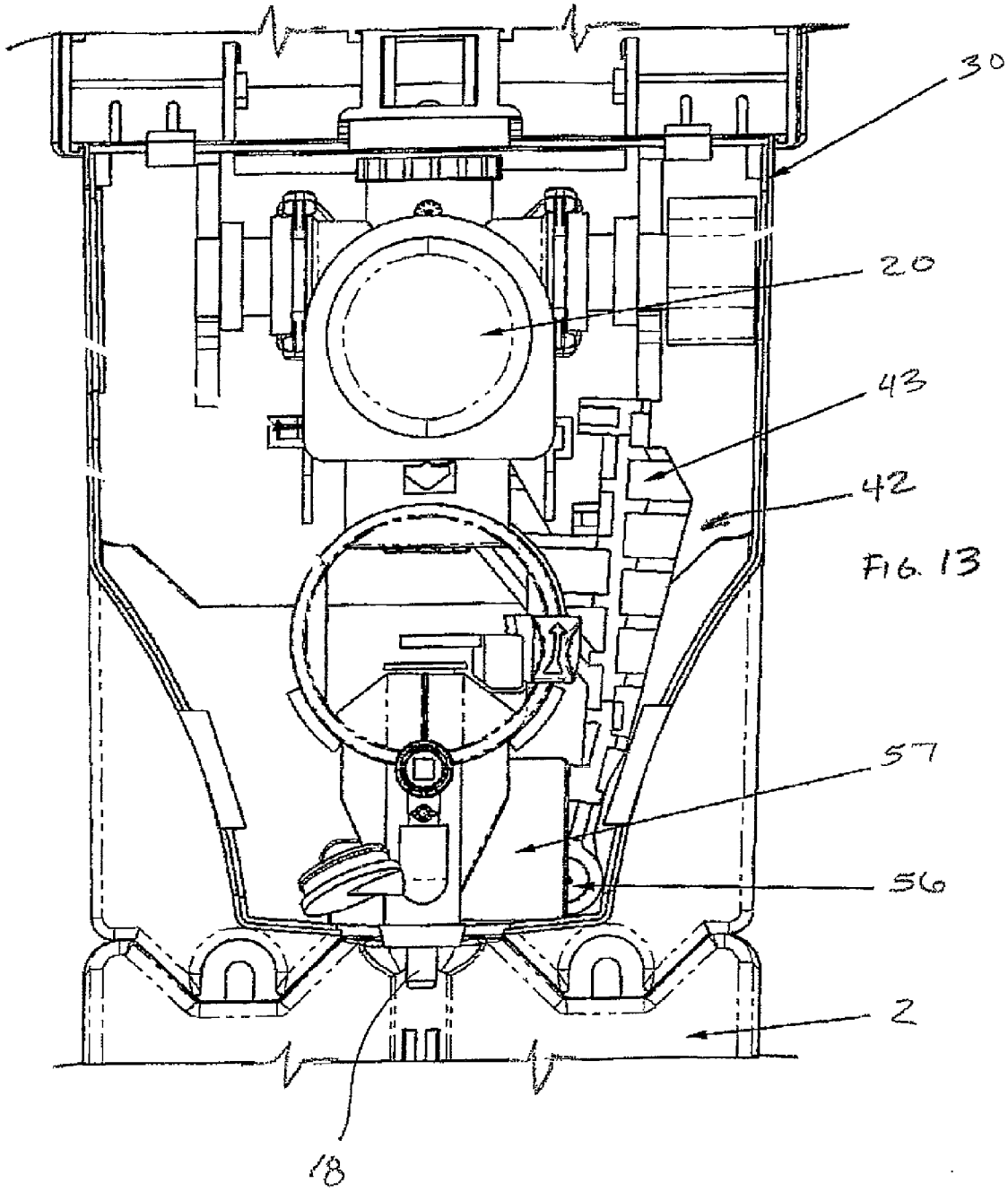
FIG. 13 is a view similar to FIG. 12 with the dispensing portion shown in the unlocked position.

A third embodiment of the dispensing apparatus is illustrated in FIGS. 11-13. This dispenser has many features that are similar to the features of the previous embodiment. Accordingly, similar features will be given similar reference numerals and will not be discussed below. Although features may be identified as being similar, it does not mean that these features are identical or perform in the exact same manner. Due to the many similar features between this embodiment and the previous embodiment, generally only the differences or new features to this embodiment will be discussed below.

With respect to functionality, the main differences between these two embodiments are found with the dispensing housing 30, and more specifically, with the dispensing lock 42. The dispensing lock 42 of this embodiment operates under the same principle as the previous embodiments by blocking the actuating mechanisms 20. However, the dispensing lock 42 is configured differently.

The dispensing lock 42 of FIGS. 1-10 had a lever arm 43 that pivoted about an axis that was normal to the actuator's 20 direction of movement. The dispensing lock 42 of this embodiment (FIGS. 11-13) has a lever arm 43 that is pivoted about an axis that is substantially parallel to the actuator's 20 direction of movement. As shown in FIGS. 12 and 13, the locking lever 43 is pivotable about pivot point 56, which has an axis that is substantially parallel to the actuator's 20 direction of movement. A portion of the lever 43 blocks the movement of the actuator 20 along its guide rails in the locked position as shown in FIG. 12. Once the lever 43 is pivoted to the unlocked position shown in FIG. 13, the lever 43 no longer blocks the actuator 20. As discussed in the previous embodiment, the lever 43 is pivoted by movement of the release mechanism 50 due to the insertion of a container 1 into the container holding device 2. As long as the container remains in the container holding device 2, the lever 43 will remain pivoted toward the unlocked position to allow fluid to be dispensed.

The lever 43 can be moved many different ways. For example, rotation from the shaft can be transferred via a set of gears or another lever 57 coupled to the shaft 52 can push against lever 43 upon insertion of the container 1 into the container holding device 2. Upon removal of the container 1 from the container holding device 2, a spring or bias element can cause the lever 43 to return to the locked position.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, various alternatives to the certain features and elements of the present invention are described with reference to specific embodiments of the present invention. With the exception of features, elements and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

We claim:

1. A dispensing apparatus for delivering fluid to a container, the apparatus comprising:

a container holding device for receiving in use a container having a fill port and a container identifier key, the container holding device including mechanical keying arranged to permit a container with a predetermined identifier key to be completely inserted to a refill position in the container holding device, a dispensing outlet for delivering fluid to the fill pod of a container at said refill position, a fluid delivery mechanism for delivering fluid to the dispensing outlet, an actuation member movable from a start position and operatively linked to the fluid delivery mechanism to cause the fluid delivery mechanism to deliver fluid in response to movement of the actuation member from said start position, and a dispensing lock including a release mechanism for releasing the dispensing lock, the dispensing lock having a first arm movable between a first position in which it blocks movement of the actuation member from said start position and a second position in which it permits movement of the actuation member, the release mechanism including a second arm coupled to the first arm via a shaft rotatable about an axis extending along the shaft, the first and second arms being positioned near opposite ends of the shaft, the second arm rotatable between a first locked position and a second released position, the second arm rotated by insertion of a container into the refill position in the container holding mechanism, rotation of the second arm from the first position to the second position causing movement of the dispensing lock from the first position to the second position, thus enabling fluid to be delivered to the container.

2. A dispensing apparatus according to claim 1, wherein the first arm is directly connected to the shaft for rotation therewith due to rotation of the second arm.

3. A dispensing apparatus according to claim 2, further comprising a locking plate rotatable about an axis being substantially parallel to the shaft, the locking plate having a lever arm rotatable between a locking position and an unlocking position to selectively prevent actuation of the actuation member, the first arm coupled to the locking plate to cause selective rotation of the locking plate.

4. A dispensing apparatus according to claim 3, further comprising a linkage extending between the first arm and the locking plate.

5. A dispensing apparatus according to claim 1, further comprising a third arm connected to the shaft opposite the second arm, the third arm being operatively coupled to the first arm to cause selective movement of the first arm.

6. A dispensing apparatus for delivering fluid to a container, the apparatus comprising:

a housing comprising a dispensing portion and a container holding portion, the dispensing portion comprising a dispensing outlet, a fluid delivery mechanism for delivering fluid to the dispensing outlet, and an actuation member movable from a start position and operatively linked to the fluid delivery mechanism to cause the fluid delivery mechanism to deliver fluid in response to movement of the actuation member from said start position, the container holding portion including a container holding bracket comprising a longitudinally extending portion and a bottle supporting portion extending substantially normal to the longitudinally extending portion, and a dispensing lock located in the dispensing portion of the housing, the dispensing lock movable between a first position in which it blocks movement of the actuation member from said start position and a second position in which it permits movement of the actuation member, a release mechanism coupled to the container holding portion of the housing, the release mechanism having an arm positioned to be rotated about a pivot point on the container holding bracket, the release mechanism also having a shaft coupled to the arm for rotation with the arm, the shaft extending in a longitudinal direction and coupled to the dispensing lock, the shaft rotatable about an axis extending along the shaft, the arm rotatable between a first position corresponding to the first position of the dispensing lock and a second position corresponding to the second position of the dispensing lock, the arm rotated by insertion of a container into the container holding bracket.

7. The dispensing apparatus according to claim 6, wherein the dispensing lock includes a lever arm coupled to the shaft, the lever arm rotatable between the first and second position of the dispensing lock to allow selective actuation of the actuation member.

8. The dispensing apparatus according to claim 7, wherein the lever arm is directly connected to the shaft for rotation therewith.

9. The dispensing apparatus according to claim 7, further comprising a linkage extending between the shaft and the lever arm.

* * * * *